US005465678A

United States Patent [19]

Ekman

[11] Patent Number: 5,465,678

[45] Date of Patent: Nov. 14, 1995

[54] PIECE OF HULL FOR BOATS AND VESSELS

[76] Inventor: Christer V. Ekman, Aisagatan 8 A 2, Fin-20780, St. Karins, Finland

[21] Appl. No.: 244,418

[22] PCT Filed: Nov. 25, 1992

[86] PCT No.: PCT/FI92/00318

§ 371 Date: May 25, 1994

§ 102(e) Date: May 25, 1994

[87] PCT Pub. No.: WO93/11039

PCT Pub. Date: Jun. 10, 1993

[30] Foreign Application Priority Data

Nov. 26, 1991 [FI] Finland ..... 915548

[51] Int. Cl.[6] ..... B63B 1/22

[52] U.S. Cl. ..... 114/284; 440/53

[58] Field of Search ..... 114/56, 57, 248, 114/77 R, 352, 271, 274, 284, 285, 289; 440/49, 53, 54, 55, 62, 63, 65

[56] References Cited

U.S. PATENT DOCUMENTS 3,815,541 6/1974 Hansen ..... 114/248
4,000,712 1/1977 Erikson et al. ..... 114/352
4,067,286 1/1978 Stout et al. ..... 114/284
4,351,262 9/1982 Matthews ..... 114/284
4,977,845 12/1990 Rundquist ..... 114/285

*Primary Examiner*—Stephen Avila
*Attorney, Agent, or Firm*—John P. White

[57] ABSTRACT

A piece of hull of a boat, vessel or other construction designed to travel over water, which piece is attached with devices to the rest of the hull in a manner that allows the pieces of hull to move relative to each other. The piece of hull is located partly or in its entirety in the bow half of the hull combination and includes at least an engine, a power transmission mechanism and a propeller or an impeller. The piece of hull according to the invention aims at minimizing as many of the negative features of boats provided with an engine as possible, such as the noise and vibrations caused by the engine, power transmission mechanism, and propeller, the shocks and violent movements caused by the action of the waves, the overturning effect of the headwind and the waves, frictional resistance, uncomfortable travelling position at low speeds, high threshold of planing, and poor steerability at low speeds. The invention has a minimizing effect on the negative features through its construction, location, and operation. The boat is steered either by a rudder or by a steering device located in the piece of hull. The piece of hull can be provided with trim planes.

8 Claims, 3 Drawing Sheets

PIECE OF HULL FOR BOATS AND VESSELS

The present invention relates to providing a boat, vessel or other construction designed to travel over water, with a second, not fixedly attached piece of hull, the aim of which is to produce a range of different advantages compared to known hull constructions. The invention is specially meant to be used in high-speed boats, vessels and vehicles designed for recreational activities on the water and can also advantageously be used in transport and fishing vessels and in stationary operating special-purpose vessels.

The vessels or the like where the invention can be used will hereinafter be referred to by the term 'boat'. The hull and the construction of a boat have to meet different demands generated by e.g. the noise and vibration caused by the engine, power transmission and propeller, the shocks and violent movements caused by waves, the overturning forces caused by the action of waves and wind, the frictional forces between the water and the hull, and the threshold of planing.

The noise and vibration problems caused by the engine and the power transmission have in a known manner been solved by separating the engine and the power transmission from the hull by antivibrators and by fixing sound absorbing and insulating materials to the walls of the engine space and by tightening the through holes. In spite of these measures, noise levels of about 80 dB(A) are common in boats.

The smashes and violent movements caused by the waves at high speeds have in a known manner been solved by giving the bottom a V-shape, using narrow hull shapes, providing the boat with hydrofoils or suspensioned pontoons and by giving a special shape to the underwater portion of the hull. By a V-shaped bottom and a narrow wedge-shaped hull, an effective wave cutting effect is achieved and the motion of the boat is stabilized, but at the same time the wetted surface area and frictional forces are increased and the boat will easily become wet at high speeds. A boat provided with hydrofoils or suspensioned pontoons will ride smoothly in small waves. Such a boat is difficult to use because of the outwardly projecting parts. If the suspensioned pontoons are located close to the midline of the boat,they will cause improper working of the propeller at the stern. By giving the underwater portion of the hull a special shape, a reduced motion will be achieved, especially with trimarans, but the wetted surface area will be large and frictional forces great.

A negative feature of boating with light high-speed boats and racers for which no good solutions have been found, is the influence of forces exerted Jointly by wind and waves, tending to lift the bow of the boat up and with the contribution of the push forces of the propeller at the back seeking to turn the boat over lengthways. The frictional forces between the water and the boat have as known been reduced by friction reducing coatings, specially shaped bows and bottoms, hydrofoils or mechanically produced air cushions. The effect of the friction reducing coatings is marginal. By designing the bow and the bottom in such a manner that air is forced under the bottom, a friction reducing effect is created that is significant at high speeds. Hydrofoils may be used to reduce the wetted surface area and friction at high speeds. The solution is expensive and calls for effective power sources at the acceleration phase. Mechanically produced air cushions are exposed to disturbances in rough weather with high waves.

The problems with avoiding the uncomfortable and decelerating bow-up position of the boat occurring at slow speeds, and with making the boat plane, have been reduced in a known manner by means of fixed or adjustable trim planes or adjustable drive pitches and fixed trim surfaces or bulbs of the hull. These are all ways of improving or complementing the basic boat.

By means of the piece of hull according to the present invention the aim is to get an overall basic construction that will make boating comfortable, safe, and energy saving for professional, recreational as well as racing purposes by minimizing as many of the above described negative features as possible.

The most essential feature of the piece of hull according to the present invention is that the piece of hull accommodates at least the engine and the power transmission and that it is partly or in its entirety located in the bow half of the boat and is attached to the main hull in a way that allows the pieces of hull to move relative to each other.

The piece of hull according to the invention prevents effectively and naturally the noise and vibrations from spreading from the engine, the power transmission system and the propeller to the main hull and the accommodations, because the noise and vibration sources are located in this separate, not fixedly attached piece of hull. The piece of hull according to the invention makes the movement of the main hull smooth even in hard weather by splitting and breaking the waves mainly through its own inertia force and the stabilizing and pushing force of the propeller.

The piece of hull according to the invention increases effectively safety on board in hard rough weather, when the weather is coming in from the direction of the bow, because the rolling motion is slowed down and because the centre of gravity of the engine is in the bow half or close to the midships of the boat. If the bow in spite of this rises from the water when the boat travels at a high speed, the speed will drop immediately, because the pushing force of the propeller fails when the propeller at the midships looses the contact with the water and the boat falls back into the water. Safety on board is also increased in a situation where the boat hits for example an underwater rock, because, due to the location of the piece of hull according to the invention it is obvious that this piece of hull is the one to hit the rock and the main hull will stay unaffected.

The piece of hull according to the invention lowers the threshold of planing and improves the travelling position of the boat at low speeds because the pushing force of the propeller does not lower the stern due to the midships or bow part location of the propeller.

The piece of hull according to the invention decreases friction at the main hull by forming the surface of the water into an air pocket. At certain speeds, there will be a downhill slope at the main hull causing a surfing effect.

The piece of hull according to the invention has a positive influence on all earlier mentioned negative features. Moreover, the piece of hull has advantages in assembling because it can be attached as the last component to a ready, furnished hull and the decision on the expensive engine and transmission equipment can be scheduled close to the delivery date. The piece of hull according to the invention is easily removable if it is damaged. By combining the piece of hull with a rudder or a swingable transmission and propeller system, a side force can be generated which essentially improves the steerability of a boat provided with an engine at slow speeds and makes it possible to keep the boat stationary in headwind.

In the following, a detailed description is given of the invention with reference to the attached drawing No. 1.

Figure 4:
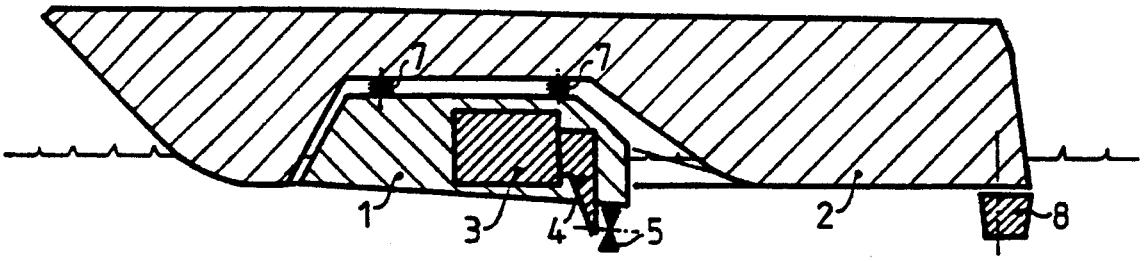

FIG. 4 4 is a longitudinal section of the boat where the piece of hull according to the invention is part of the bottom.

Figure 5:
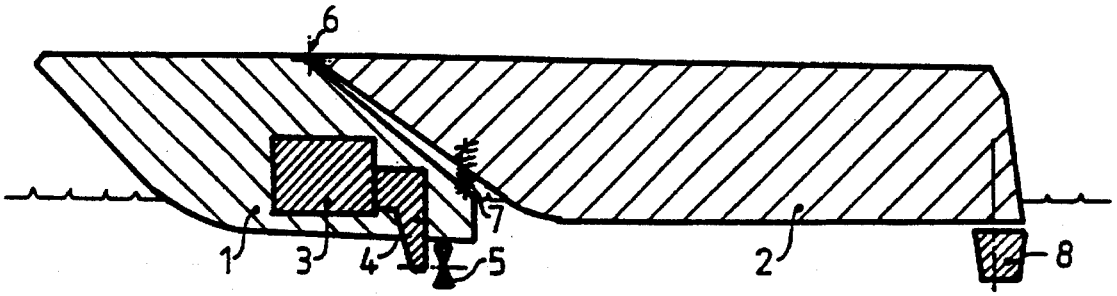

FIG. 5 is a longitudinal section of the boat where the piece of hull according to the invention is part of the stem.

Figure 6:
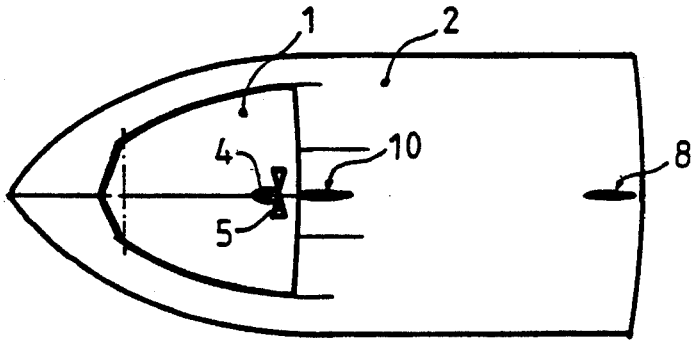

FIG. 6 is a bottom view with the piece of hull according to the invention provided with a rudder.

Figure 7:
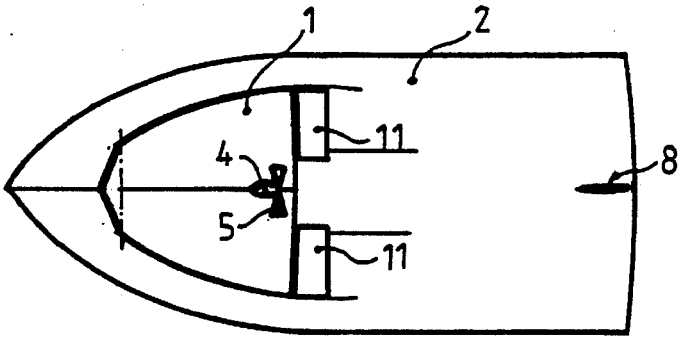

FIG. 7 is a bottom view with the piece of hull according to the invention provided with a trim plane.

Figure 8:
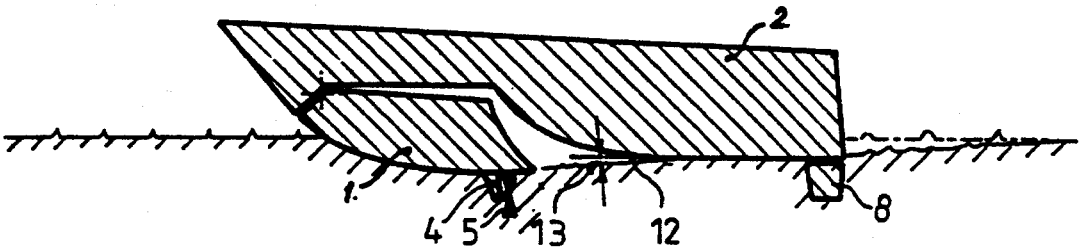

FIG. 8 is a longitudinal section of the boat showing the effect of the piece of hull according to the invention on the surface of the water.

Figure 1:
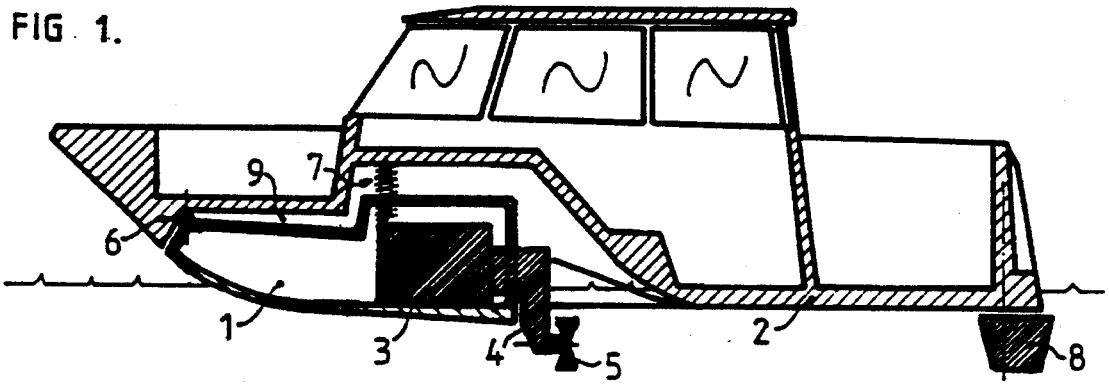
FIG. 1 is a schematic longitudinal section of the boat.

FIG. 1 shows a longitudinal section of the boat according to the invention. Part 1 is a piece of hull, which includes an engine 3, a transmission system 4 and a propeller 5. The piece of hull L is attached to a piece of hull 2 with hinges 6, which can be antivibration mounted, and a suspension 7 which can be provided with a spring system, and shock absorbers. There may be one or more suspension devices. A rudder 8 is located in the stern. There may be one or more rudders. An air space 9 is the space between the pieces of hull 1 and 2 where the motion of the piece of hull 1 takes place. When the boat is lying still, the piece of hull 1 carries its own weight partly or totally or partly also the weight of the hull 2, depending on the displacement of the hull 1. At a high speed, the piece of hull 1 carries as a general rule its own weight and part of the weight of the hull 2. The shape, width and length of the piece of hull according to the invention may vary, depending on the kind of features desired of the boat. The bottom of the piece of hull 1 is preferably of a low V-shape. The bottom shape of the piece of hull 2 is preferably quite plane in the stern area or even curved convex in the transverse direction. Where the pieces of hull 1 and 2 overlap, their geometrical shapes can be similar, yet so that the piece of hull 1 can move freely within the zone limited by the extension of the suspension. The course of the motion can be a pendulum motion where the hinges 6 are in the front side, as in FIG. 1, or alternatively either in the rear or the middle portion of the hull 1, or an up and down motion, a forward and backward motion, a combined motion or a vibratory motion depending on the suspension system. The combination of the engine 3, transmission 4 and propeller 5 may vary as to its parts, and all known systems are possible, such as the S-transmission, in-outboard, outboard, water let and the conventional inboard propeller system etc. The propeller can be either of pushing or pulling type. There may be one or more engines. The piece of hull 1 can accommodate such devices as accumulators, fuel and water tanks and water cooling systems etc.

Figure 2:
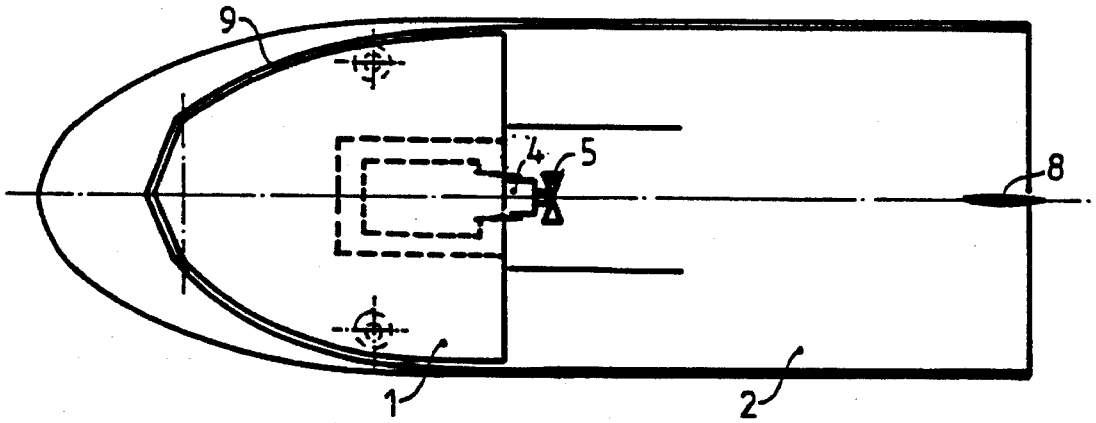
FIG. 2 is a bottom view of the boat according to the invention.

FIG. 2 shows a schematic view of the bottom of the boat according to the invention. The piece of hull 1 according to the invention is attached to the piece of hull 2. The air pocket, which is formed under the piece of hull 2 at high speeds, is filled with air which flows through the space 9, which is the space between the two pieces of hull where the motion of the piece of hull 1 takes place and which opens up into the atmosphere above the waterline.

Figure 3:
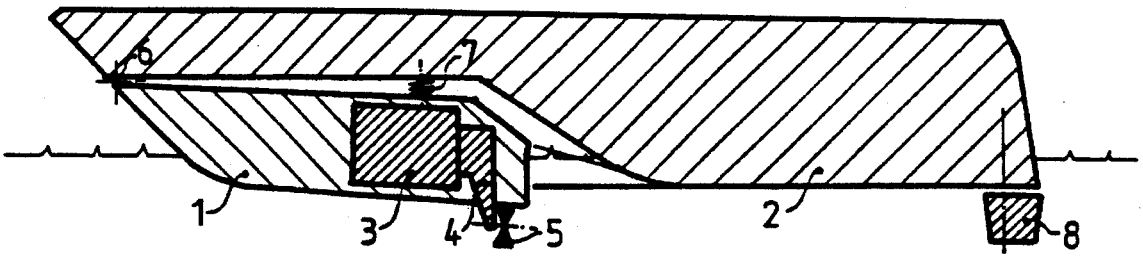
FIG. 3 is a longitudinal section of the boat where the piece of hull according to the invention is part of the bow.

FIG. 3 shows a longitudinal section of the boat according to the invention where the piece of hull 1 according to the invention is located at the bowside of the combination of the pieces of hull 1 and 2.

FIG. 4 shows a longitudinal section of the boat according to the invention where the piece of hull 1 according to the invention is located close to the middle section of the combination of the pieces of hull 1 and 2.

FIG. 5 shows a longitudinal section of the boat according to the invention where the piece of hull 1 according to the invention is part of the stem.

FIG. 6 shows a sectional view of the bottom of the boat according to the invention where the piece of hull 1 according to the invention, which is attached to the piece of hull 2, is provided with a rudder 10. As an alternative may be used a swingable transmission system, a swingable water jet or a swingable water nozzle. Hereby a side force effect is created which is either the main steering force in all speed registers or a second temporary means of steering at slow speeds or when the boat is lying parked, in which cases the main steering forces are concentrated in the rudder 8 at the stern of the piece of hull 2.

FIG. 7 shows the bottom of the boat according to the invention where the piece of hull 1 according to the invention, which is attached to the piece of hull 2, is provided with trim planes Lb. The trim planes 11 are used to adjust the position or depth of the piece of hull 1 or to correct the heel of the boat. By providing the trim planes with an elastically fixed positioning device, it is possible to affect the ability of the boat to absorb shocks caused by waves.

FIG. 8 shows a sectional view of the effect on the surface of the water of the piece of hull 1 according to the invention. The piece of hull 1 shapes at the planing speed the surface of the water into an air pocket 12 the form of which is determined by the cross-sectional shape of the piece 1. At the same time a downhill slope 13 is formed at the piece of hull 2, the inclination of said slope depending on the weight and shape of the piece of hull 1 and the speed of the boat.

I claim:

1. Additional hull in a boat unit, vessel or other preferably monohull construction designed to travel over water, said additional hull comprising at least an additional hull section, a drive unit of the boat with possible transmission mechanism and a propulsion mechanism; said additional hull section attached to a main hull section of the boat unit by joint means allowing pivotal inter-hull movement between the additional hull section and the main hull section while substantially eliminating longitudinal movement between the additional hull section and the main hull section; said additional hull section forming a portion of the bottom flow surface of the total hull against the water, characterized in that said additional hull section is for the greater part located in the bow half of the total hull, forms an integral part of said total hull and that said joint means between the additional and main hull sections comprise at least a suspension means allowing the motion of the additional hull section, while the boat is travelling, relative to the main hull section within the limits defined by the waves and the boat travelling counterforces, attenuating the motion of the main hull section.

2. A hull according to claim 8, characterized in that said additional hull section comprises one or several of the following parts: a rudder, a directable propulsion device, a directable propulsive water jet, a directable propulsive water nozzle.

3. A hull according to claim 8, characterized in that said additional hull section is provided with one or several trimming planes whereby the effect of the trimming planes is, through said joint means, indirectly transmitted to said main hull section.

4. A hull according to claim 8, characterized in that between the main hull section and the additional hull section is provided a gap in order to get space for said inter-hull motion, that said gap opens at one end above the waterline into the atmosphere and extends at another end below the water level under the total hull forming a channel and that all or part of the air flowing through said channel is lead under the aft half of the total hull with said gap varying during the travel of the boat unit.

5. A hull according to claim 1, characterized in that said additional hull section is provided with such form of the bottom flow surface that this flow surface portion at high travelling speeds, by shaping the surface of the contacted water, produces one or several grooves in the water leaving said additional hull section, which grooves at the main hull section form one or several air pockets, the size of said air pockets varying during the travel of the boat unit.

6. A hull according to claim 1, characterized in that said additional hull section at high travelling speeds, by shaping the surface of the contacted water, produces at the main hull section a downhill slope with respect to the travelling direction of said boat unit.

7. A hull according to claim 5, characterized in that said additional hull section at high travelling speeds, by shaping the surface of the contacted water, produces at the main hull section a downhill slope with respect to the travelling direction of said boat unit.

8. A hull according to claim 1, characterized in that said joint means comprise hinge means and that said suspension means comprise resilient means such as springs and/or yielding means such as shock absorbers.

* * * * *